US011753286B2

(12) United States Patent
Forno

(10) Patent No.: US 11,753,286 B2
(45) Date of Patent: Sep. 12, 2023

(54) DEVICE FOR GRIPPING AND CENTRING BOTTLES FOR CAPPING INSTALLATIONS

(71) Applicant: FT SYSTEM S.R.L., Alseno (IT)

(72) Inventor: Marco Forno, Asti (IT)

(73) Assignee: FT SYSTEM SRL, Alseno (IT)

( * ) Notice: Subject to any disclaimer, the term of this patent is extended or adjusted under 35 U.S.C. 154(b) by 218 days.

(21) Appl. No.: 16/610,497

(22) PCT Filed: May 2, 2018

(86) PCT No.: PCT/IB2018/053026

§ 371 (c)(1),
(2) Date: Nov. 2, 2019

(87) PCT Pub. No.: WO2018/203242

PCT Pub. Date: Nov. 8, 2018

(65) Prior Publication Data

US 2020/0156913 A1 May 21, 2020

(30) Foreign Application Priority Data

May 3, 2017 (IT) ..... 102017000047740

(51) Int. Cl.
*B67B 3/20* (2006.01)

(52) U.S. Cl.
CPC ..... *B67B 3/206* (2013.01)

(58) Field of Classification Search
CPC .. B67B 3/206; B67B 3/20; B67B 3/00; B67C 3/00; B67C 3/008
USPC ..... 53/485, 317, 490, 329
See application file for complete search history.

(56) References Cited

U.S. PATENT DOCUMENTS 2,987,313 A 6/1961 Bjering et al.
4,469,362 A 9/1984 Schaarschmidt et al.
4,939,890 A * 7/1990 Peronek ..... B67C 7/004 53/317
6,302,172 B1 10/2001 De Villele
(Continued)

FOREIGN PATENT DOCUMENTS

CN 2225466 Y 4/1996
EP 1712496 A1 10/2006
(Continued)

*Primary Examiner* — Valentin Neacsu
*Assistant Examiner* — Mary C Hibbert-Copeland
(74) *Attorney, Agent, or Firm* — Howson & Howson LLP

(57) ABSTRACT

A device for gripping and centring containers, in particular bottles of which the neck is provided with a rigid collar, in a capping and/or control station of a capping installation is provided and includes a centring ring, intended for being inserted onto a container and for resting on an upper portion of the body of the container, and a plurality of jaws, distributed along the circumference of the centring ring and arranged to receive, in an operating condition, the region of the neck of the container located immediately below the rigid collar. The centring ring is associated with moving members arranged to control a displacement thereof in vertical direction, and the jaws are associated with moving members arranged to control a displacement thereof in vertical direction, simultaneously with or independently of the vertical displacement of the centring ring, and a displacement in horizontal direction. A capping installation is also disclosed.

7 Claims, 5 Drawing Sheets

(56) References Cited

U.S. PATENT DOCUMENTS

| | | | | |
|---|---|---|---|---|
| 8,439,413 | B2 | 5/2013 | Cirio | |
| 2012/0056062 | A1 | 3/2012 | Fahldieck | |
| 2012/0085068 | A1* | 4/2012 | Cirio | B67B 3/18 53/317 |
| 2012/0318405 | A1* | 12/2012 | Spasov | B67C 3/202 141/83 |
| 2015/0315002 | A1 | 11/2015 | Lander et al. | |

FOREIGN PATENT DOCUMENTS

| | | | | |
|---|---|---|---|---|
| EP | 2653436 | A1 | | 10/2013 |
| FR | 2289433 | A1 | | 5/1976 |
| GB | 276724 | A | | 8/1927 |
| GB | 994840 | A | * | 4/1962 |
| JP | H02-166089 | A | | 6/1990 |

* cited by examiner

DEVICE FOR GRIPPING AND CENTRING BOTTLES FOR CAPPING INSTALLATIONS

TECHNICAL FIELD

The present invention relates to capping installations and more particularly it concerns a device for gripping and centring containers and a method of retaining and centring a container under a capping head.

Preferably, the invention is applied in capping installations and capping heads in which screw caps are applied to containers having a neck equipped with a rigid collar and in which gripping and centring take place by acting on the neck region immediately below the collar, and the following description will refer in particular manner to such a preferred application.

In the preferred application, the containers are bottles and, for the sake of clarity and simplicity, the term "bottles" will always be used in the following description.

Moreover, taking into account that in many capping installations the capping heads also have measurement and/or control tasks, for instance measurement of a cap screwing/unscrewing torque or of the pressure of gases present between a liquid contained in the container and the cap, control of physical or visual characteristics of the container, etc., in the following description and in the claims the capping head will be generally referred to as "working head".

PRIOR ART

In order capping, measurement and/or control operations in the capping stations of a capping installation take place correctly, it is essential that the bottles are arranged in perfectly vertical position and aligned with the axis of the head and the cap, and maintain such a position during the operations performed in such stations. To this end, the capping stations are equipped with devices for gripping and centring the bottles, which are to ensure the correct positioning of the bottle relative to the working head and to prevent bottle torsions due to rotational movements of the working head during capping.

In bottles having the rigid collar, the gripping and centring devices generally include a supporting element which has a side recess where the neck of the bottle is received and on which the rigid collar rests, and a pincer element for retaining the bottle in the recess. Examples of such devices are disclosed in EP 1 712 496 A1, EP 2 383 221 A1, EP 2 439 168 A1 and U.S. Pat. No. 6,302,172 B1.

The prior art solutions have some drawbacks.

Actually, during the capping and measurement or inspection phase, a vertical force (top load) is applied to the bottle, which load tends to increase the frictional force on the neck region in order to prevent the bottle from rotating about itself or anyway from displacing from the pre-set position. Such a top load can give rise to misalignments between the axes of the bottle, of the cap and of the working head, which cause errors in the form of axial or tangential forces unrelated to the parameters of the cap closing or opening torques. In case of bottles made of plastics, the compression, acting on the soft side portion of the bottle, causes a change in the values of pressure of gases inside the bottle itself, thereby making reading of the residual pressure of gases present between liquid and cap impossible both in conventional manner, by means of compression tools associated with the bottle, and by means of gas-chromatographic techniques.

EP 2 383 221 A1 discloses a gripping and centring assembly in which the action of an anti-rotation blocking element during capping is discharged on the neck of the bottle, without stressing the thread and the collar. The problems caused by the top load, which, as known, generally is of one order of magnitude greater than the axial forces exerted by the capping head during cap application, are not confronted with.

EP 2 439 168 A1 discloses use of elastic elements associated with the gripping and centring devices and with cups supporting the bottles, in order to at least partially discharge the axial forces exerted by the capping head during cap application. Also this document does not confront with the problems caused by the top load.

Problems of misalignment between the head, the cap and the bottle can occur also in gripping and centring devices for bottles lacking the rigid collar, such as the devices disclosed in US 2015/0315002 A1, where torsion protection elements block the warranty band guaranteeing the integrity of a screw cap.

DESCRIPTION OF THE INVENTION

It is an object of the present invention to provide a device for and a method of gripping and centring a bottle under a working head in a capping installation, which obviate the drawbacks of the prior art.

A device according to the invention includes:

a centring ring, which is intended for being inserted onto a bottle and for resting on an upper portion of the bottle body and is associated with moving members arranged to control a displacement thereof in vertical direction, parallel to an axis of the bottle; and a plurality of jaws, distributed along the circumference of the centring ring and arranged to engage, in an operating condition, the neck of the bottle, the jaws being associated with moving members arranged to control a displacement thereof in radial direction, in order to move the jaws from an idle condition, in which they are spaced apart from the neck, to the operating condition, and vice versa.

The centring ring and the plurality of jaws are moreover associated with moving members arranged to control a simultaneous vertical displacement movement of the centring ring and of the plurality of jaws.

Advantageously, the jaws are uniformly distributed along the circumference of the centring ring.

In the preferred case of bottles of which the neck has a rigid collar, in the operating condition the jaws are arranged to engage the region of the neck of a bottle located immediately below the rigid collar.

Advantageously, the jaws are equipped with teeth or rubber elements in order to engage either the region of the neck of the bottle located immediately below the rigid collar or the rigid collar. The teeth may be vertically arranged and may be adapted to penetrate, in the operating condition of the jaws, into a lower surface of the rigid collar. In the alternative, the teeth are horizontally arranged and are adapted to grasp, in the operating condition of the jaws, the region of the neck of the bottle located immediately below the rigid collar.

The invention also relates to a capping installation, comprising at least one capping station with a working head for performing capping of bottles and carry out measurements and/or controls on the same bottles, and a centring device according to the invention.

A method according to the invention includes the steps of:

bringing the bottles, resting onto a supporting plane and arranged with vertical axis, to a capping station of a capping installation, which station includes at least one working head associated with a centring device according to the invention;

lowering the device onto a bottle to be capped and/or controlled, as far as the centring ring rests on an upper portion of the body of the bottle;

simultaneously moving the jaws in radial direction towards the neck of the bottle and bringing them into a first operating position, in which the jaws are in contact with the neck;

spacing apart the bottle from the supporting plane (by lifting the bottle or, in the alternative, by lowering the supporting plane) and making the bottle properly rest against the surfaces of the jaws by means of a relative translational movement of the ring and the jaws;

carrying out the operations provided for in the capping station on the bottle properly resting against the jaw surfaces, while keeping the bottle at a distance from the supporting plane.

In the preferred application in which the bottles have the rigid collar, the step of bringing the jaws into the first operating position brings the same jaws into engagement with a region of the neck of a bottle located immediately below the rigid collar and such that the latter rests onto an upper surface of each clamp.

Advantageously, the jaws are equipped with teeth or rubber elements that retain the container in the operating condition of the jaws. In an embodiment in which the jaws are equipped with vertical teeth, the step of making the bottle properly rest against the surfaces of the jaws causes the teeth to penetrate into a lower surface of the rigid collar, thereby blocking the bottle relative to the working head. In an embodiment in which the jaws are equipped with horizontal teeth arranged to engage a region of the neck of the bottle located immediately below the rigid collar, after the step of spacing apart the bottle from the supporting plane and making the bottle properly rest against the surfaces of the jaws, the method includes the step of applying a grasping pressure to the neck suitable to block the bottle during the operations carried out in the capping station.

BRIEF DESCRIPTION OF THE FIGURES

The above and other features and advantages of the invention will become apparent from the following description of preferred embodiments made by way of non-limiting example with reference to the accompanying drawings, in which.

DESCRIPTION OF PREFERRED EMBODIMENTS

Figure 1:
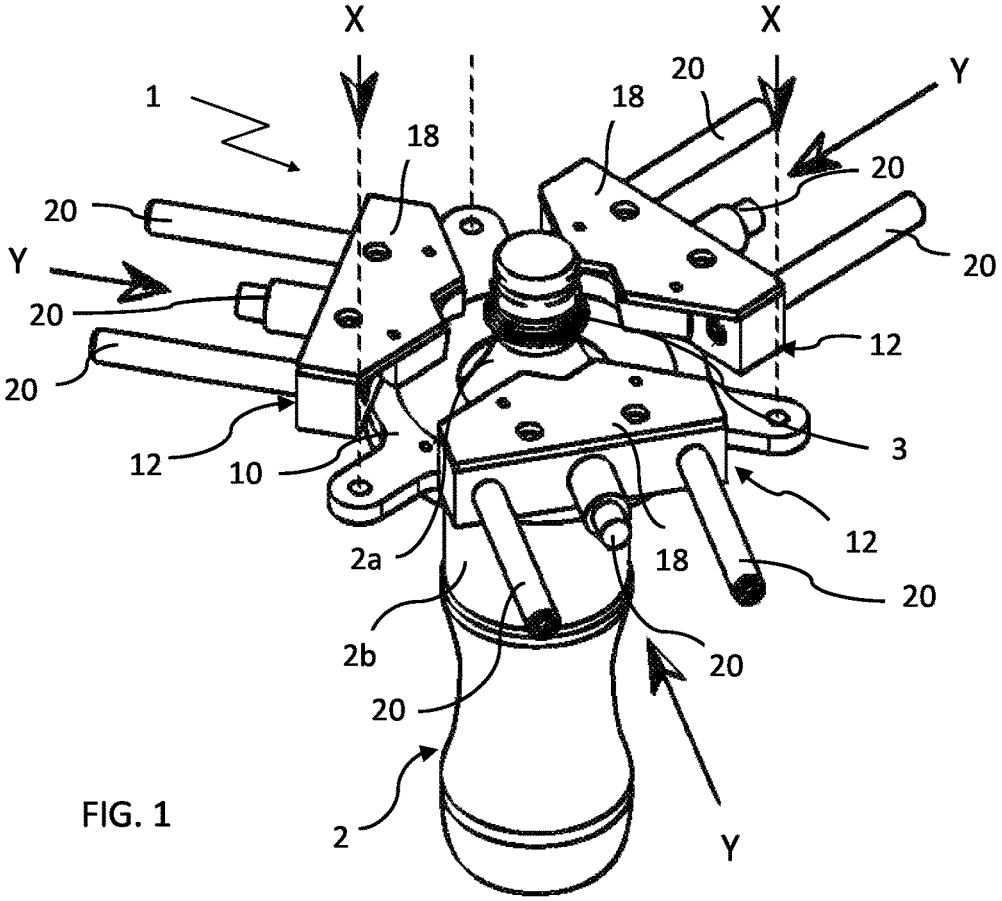
FIG. 1 is a top perspective view of the gripping and centring device according to the invention applied onto a bottle.
Figure 2:
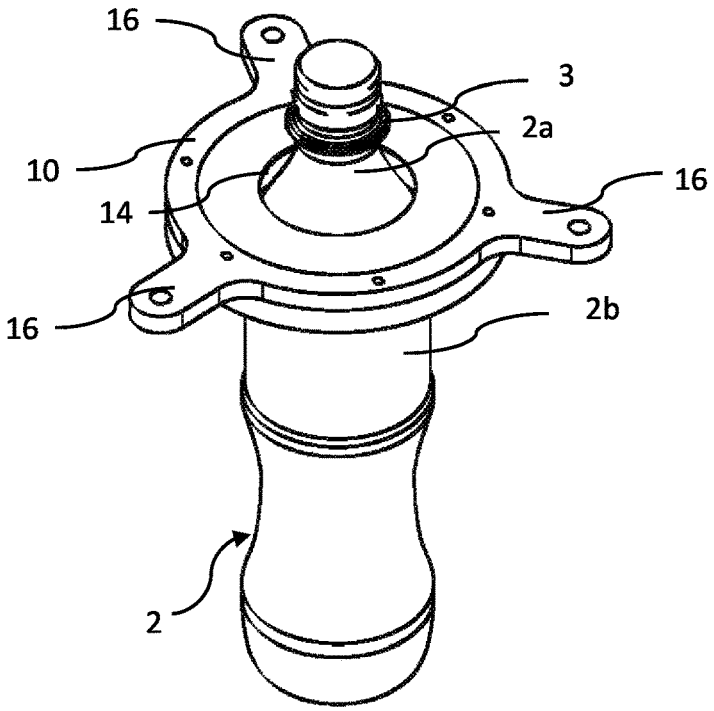
FIG. 2 is a view similar to FIG. 1, showing the centring ring only, without the jaws.
Figure 3:
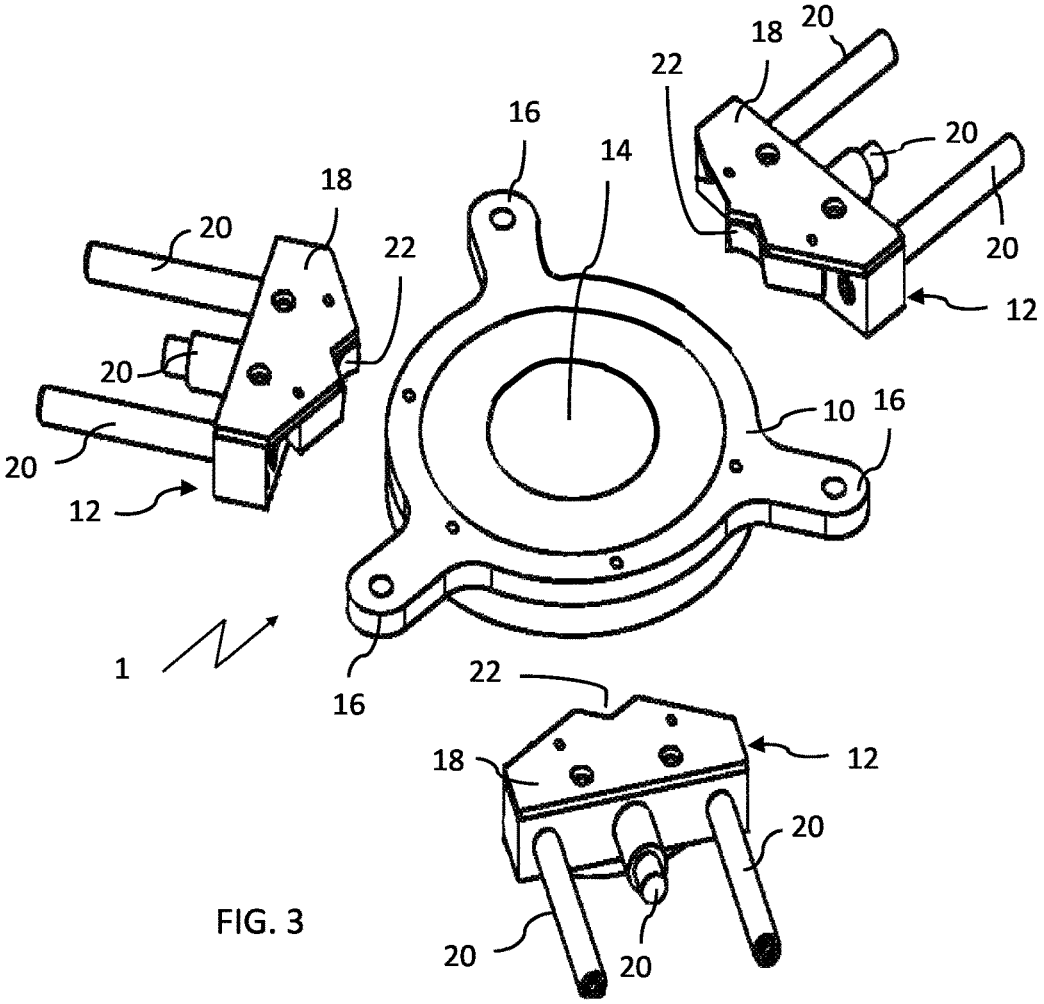
FIG. 3 is an exploded view of the device according to the invention.
Figure 4:
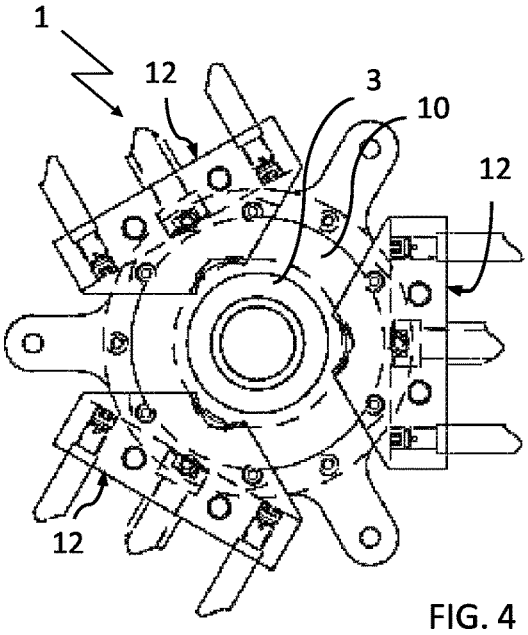
FIGS. 4 and 5 are top views of the device according to the invention, in idle position and in operating position, respectively.
Figure 5:
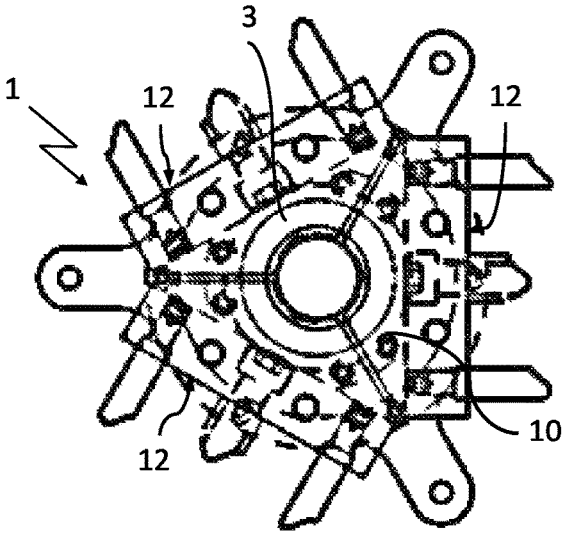

Referring to FIGS. 1 to 6, there is shown a device 1 according to the invention for gripping and centring bottles 2, more particularly bottles having a rigid collar (ledge) 3 in the area of neck 2*a*. Device 1 is associated with a working head 4, shown in FIG. 11, located in a capping and control station of a capping installation for applying for instance screw caps 5 (FIG. 11) to bottles 2.

Device 1 essentially consists of a centring ring 10 intended to rest against a bottle 2 in the region between neck 2*a* and body 2*b*, where bottle 2 widens out and forms an abutment, and of a plurality of jaws 12 (three in the example illustrated), located above ring 10 and preferably equally spaced along the circumference of ring 10.

The whole device 1 can be vertically displaced, as shown by arrows X, parallel to an axis A (FIGS. 7 to 11) of bottles 2 (axial translation). Moreover, ring 10 and jaws 12 can perform independent axial translational movements and jaws 12 can be horizontally translated relative to ring 10 (radial translation), as shown by arrows Y, from an idle position, shown in FIG. 4, where the jaws are spaced apart from neck 2*a* of bottle 2, and an operating position, in which jaws 12 engage a region of neck 2*a* located immediately below rigid collar 3 and the latter rests on the jaws. As it will be better disclosed below, depending on the structure of jaws 12, in the working position, at least in a first step, jaws 12 can engage neck 2*a* without however applying a grasping pressure.

Ring 10 has a central hole 14 for the insertion of device 1 onto bottle 2 and is provided with radial arms 16 for connection to suitable members (not shown) controlling the vertical displacement of ring 10.

Jaws 12 in turn have a body 18 connected to suitable members (not shown) controlling the vertical displacement, which are arranged to enable an axial displacement of jaws 12 jointly with or independently of the displacement of ring 10. Body 18 is mounted on guiding and/or supporting rods 20, in turn connected to members, they too not shown, controlling the horizontal translation.

The vertical displacement of the whole device 1, the vertical independent displacement of ring 10 and jaws 12 and the horizontal displacement of the jaws can be obtained by means of mechanical, hydraulic or pneumatic devices. Devices of such kind suitable for the purpose are well known to those skilled in the art and are not part of the invention, so that a further description thereof is not necessary.

Figure 6A:
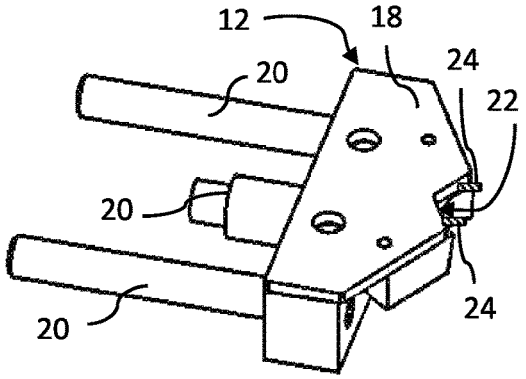
FIGS. 6*a* to 6*c* are top perspective views of some exemplary embodiments of the jaws.
Figure 6B:
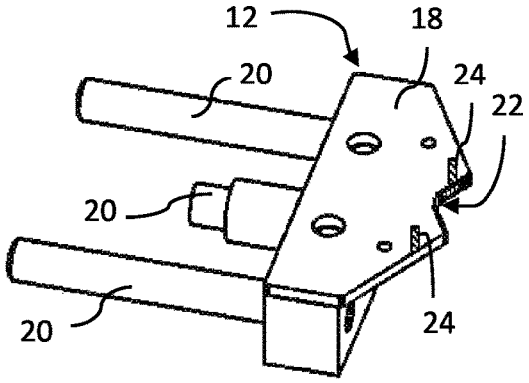

Body 18 of each jaw 12 has, in its front part, a recess 22 for receiving neck 2*a* of bottle 2 during the centring operation. Three jaws ensure the concentricity between neck 2*a* and head 4. Recess 2 can have different cross-sectional shapes, for instance a triangular shape (as shown in FIG. 6*a* or 6*b*) or a circular shape (FIG. 6*c*).

Figure 6C:
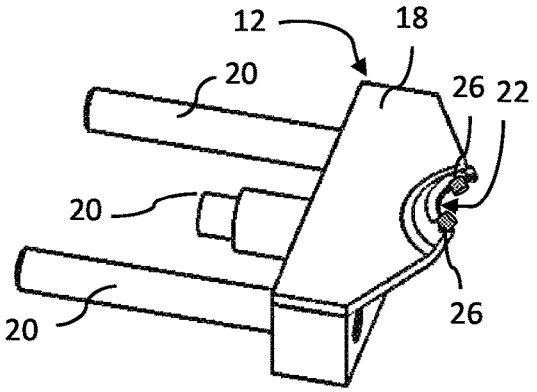

In order to engage bottle 2, jaws 12 can be equipped with teeth 24 (FIG. 6*a* or 6*b*) or rubber elements 26 (FIG. 6*c*). Teeth 24 may be horizontal (i.e. radially arranged relative to collar 3), as illustrated in FIG. 6*a*, in which case they engage the region of neck 2*a* located immediately below rigid collar 3 (underledge region). In the alternative, teeth 24 may be vertical (axially arranged relative to collar 3), as illustrated in FIG. 6*b*, in which case they engage the bottom horizontal portion of collar 3. The vertical teeth are used for instance when the plastic in the underledge region is soft: indeed, in such case, horizontal teeth could leave marks that would be tolerated in destructive test, but not in non-destructive tests.

FIGS. 7 to 11 illustrate various steps of the method according to the invention, in case the jaws are equipped with horizontal teeth or rubber elements.

Figure 7:
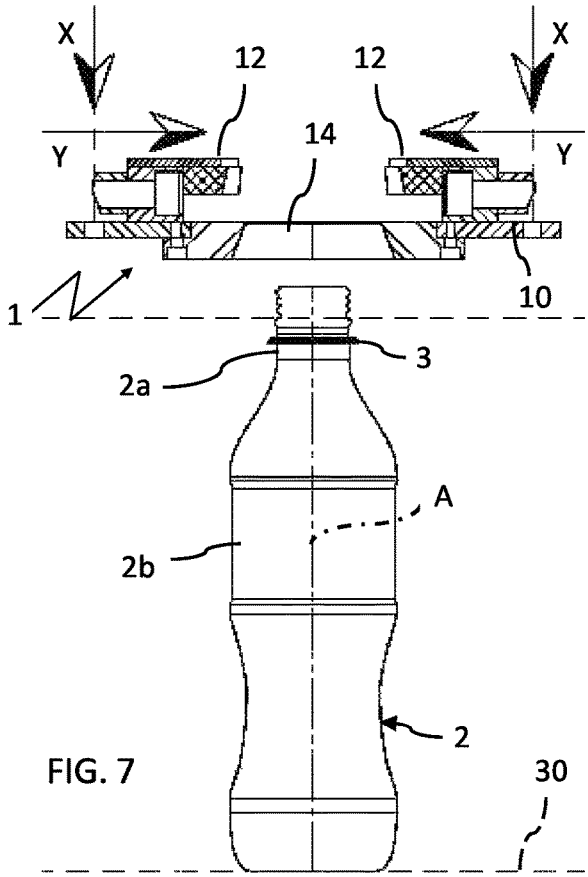
FIGS. 7 to 11 are schematic views illustrating some steps of the centring method according to the invention.
Figure 8:
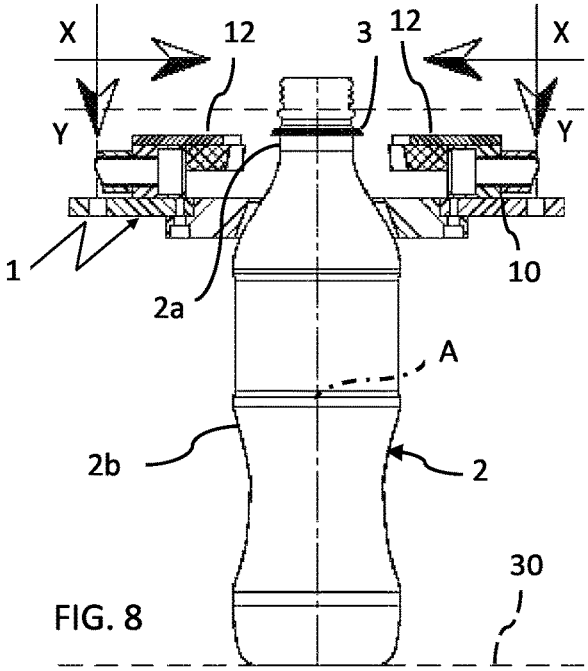
Figure 9:
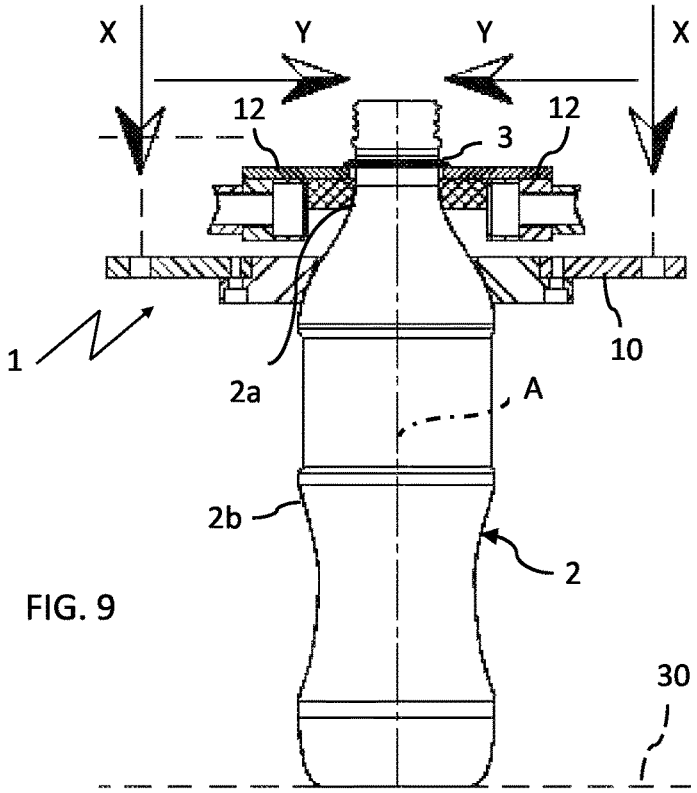

FIG. 7 shows that bottle 2 is brought in correspondence of working head 4 (FIG. 11) in a capping station by a conveying unit having a supporting plane, the trace of which is denoted 30, on which bottle 2 rests by means of its base. Of course, in an industrial installation, the conveying unit will successively convey a plurality of bottles 2 to the capping station.

When the bottle is in position under the working head, the whole device 1 is lowered (FIG. 8), thereby causing ring 10 to rest on the abutment formed by the region connecting neck 2*a* and body 2*b* of bottle 2.

At this point, jaws 12, which until that moment were spaced apart from bottle 2, are radially moved towards neck 2*a* and are brought to a pre-grasping configuration (FIG. 9), in which they support collar 3 and receive neck 2*a* in their recess 22, yet still without grasping the neck. In such a pre-grasping configuration, situations in which jaws 12 possibly do not uniformly adhere to bottle 2 can be obviated: indeed, the bottle could be not exactly vertical on supporting plane 30, or off-axis situations could occur due for instance to non-uniform jaws 12 (a jaw is more worn than another one) or to non-uniform radial movements of the jaws.

Figure 10:
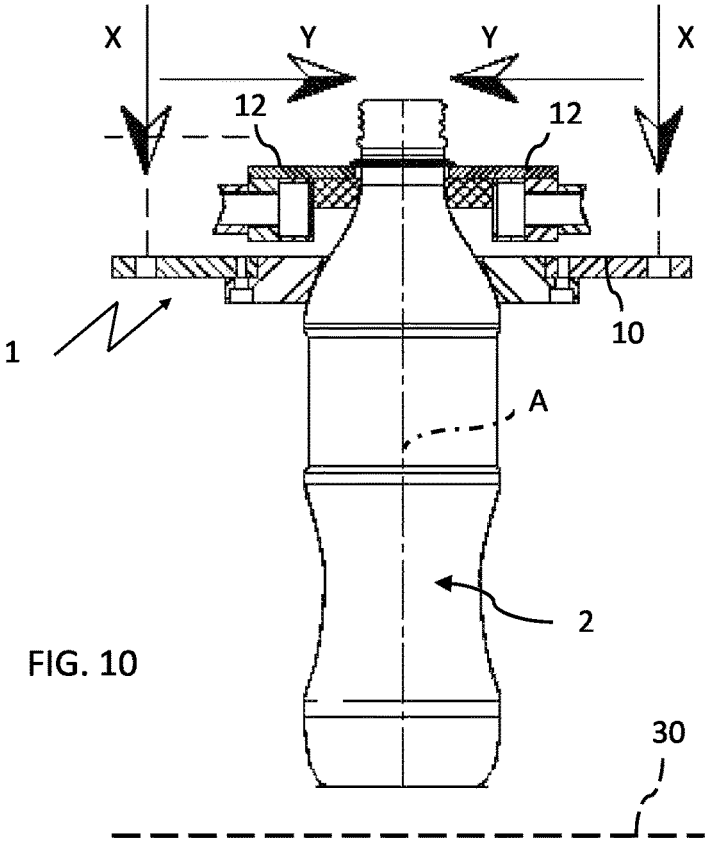

Bottle 2 is spaced apart from supporting plane 30 by lifting device 1, as shown in FIG. 10, and an axial force is applied to bottle 2, for instance through a relative translational movement of ring 10 and jaws 12, in order to achieve a correct abutment against the walls of recesses 22 and the top planar surfaces of jaws 12.

Figure 11:
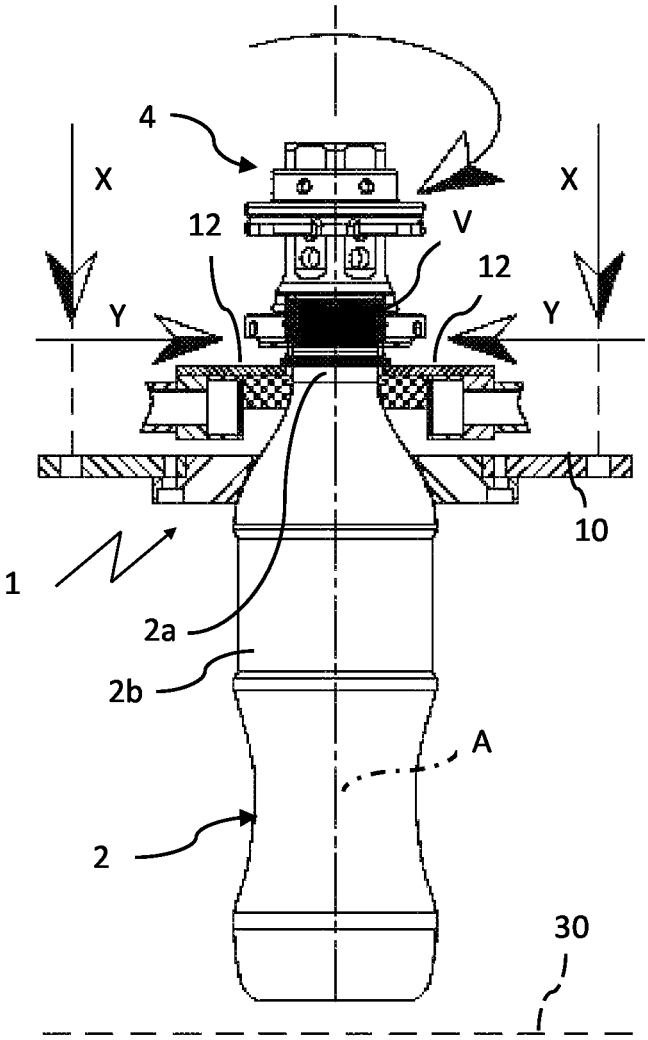

Subsequently, by means of the control systems of jaws 12, a further pressure can be applied against neck 2*a* in order to tightly grasp it and prevent any rotation of the bottle. At this point, as shown in FIG. 11, working head 4 is brought in contact with the mouth of bottle 2 by means of a roto-translational movement, and the cap application and the other operations required on capped bottle 2 can be performed.

It is to be appreciated that the grasping step above is not provided for in case of jaws having vertical teeth 24, since the teeth penetrate into the material of collar 3 due to the force applied to achieve the correct abutment of the bottles against the jaw surfaces, and hence the rotation of bottle 2 is already prevented at the end of the pre-grasping step.

In accordance with a variant embodiment of the invention, the step in which the bottle is spaced apart from the supporting plane can be performed by keeping device 1 stationary and by lowering supporting plane 30.

The above description shows that the invention enables blocking bottle 2 by means of a grasp applying a force orthogonal to the bottle itself and uniformly distributed around neck 2*a*, in a manner ensuring concentricity between bottle 2 and working head 4. Blocking therefore takes place without using vertical top loads and without using techniques that could cause torsion of bottle body 2*b*.

In this way, it is possible to achieve a same friction level on the bottle region located below collar 3; yet, unlike the known solutions, torsion of cap 5 on the thread during both cap application and cap removal is no longer affected by the top load.

Of course, during capping, it is necessary to apply to cap 5 the axial load required to bring the warranty band guaranteeing the cap integrity beyond the security references: yet, the force applied by such a load is lower by one order of magnitude than the force applied by the top loads (typically 0.5 to 1 kg instead of 15 to 25 kg), so that the above mentioned drawbacks do not exist.

Anyway, should the bottle have to be blocked by means of an axial top load, the latter can be applied below the centring device, and hence it does not affect the capping and/or measurement conditions.

It is clear that the above description is given only by way of non-limiting example and that the construction details and the embodiments can be widely changed with respect to what has been described and shown, without thereby departing from the scope of the invention as defined by the following claims.

The invention claimed is:

1. A device (1) for gripping and centring containers (2) in a capping and/or control station of a capping installation, said device comprising:

a centring ring (10), which is intended for being inserted onto a container (2) by being lowered from an initial position above the container (2) to a final position, in which the centring ring (10) rests on an upper portion of a body (2*b*) of the container (2), the centring ring (10) being associated with moving members arranged to control a displacement thereof in a vertical direction, from said initial position to said final position, parallel to an axis (A) of the container (2); and a plurality of jaws (12), located above the centring ring (10), distributed along a circumference of the centring ring (10) and arranged to engage, in an operating condition, a region of a neck (2*a*) of the container (2) located immediately below a rigid collar (3) of the container (2), the jaws (12) being associated with moving members arranged to control a displacement thereof relative to the centring ring (10) in a radial direction, in order to move the jaws from an idle condition, in which they are spaced apart from the neck (2*a*), to the operating condition, and vice versa;

wherein the jaws (12) are equipped with teeth (24) or rubber elements (26) positioned to directly engage the region of the neck (2*a*) of the container located immediately below the rigid collar, in order to retain the container (2) in the operating condition of the jaws (12).

2. The device according to claim 1, wherein the centring ring (10) and the jaws (12) are associated with moving members arranged to control a simultaneous vertical displacement of the centring ring (10) and the jaws (12).

3. The device according to claim 1, wherein the jaws (12) are uniformly distributed along the circumference of the centring ring (10).

4. The device according to claim 1, wherein the jaws (12) are equipped with horizontal teeth (24) or rubber elements (26) arranged to engage, in the operating condition of the jaws (12), the region of the neck (2*a*) of the container (2) located immediately below the rigid collar (3).

5. An installation for capping containers (2), including at least one capping station having a working head (4) for capping containers (2) and carrying out measurements and/or controls on same and a gripping and centring device (1) according to claim 1.

6. A method of centring containers (2) relative to a working head (4) provided in a capping and/or control station of a capping installation, which station is associated with a gripping and centring device (1) according to claim 1, the method comprising the steps of:

bringing the containers (2), resting onto a supporting plane (30) and arranged with vertical axis (A), to the capping station;

lowering the gripping and centring device (1) onto a container (2) to be capped and/or controlled, from an initial position above the container (2) to a final position in which the centring ring (10) rests on the upper portion of the body (2*b*) of the container (2);

simultaneously moving the jaws (12) relative to the centring ring (10) in the radial direction towards the neck (2*a*) of the container (2) and bringing the jaws (12) into a first operating position, in which the jaws are in contact with the neck (2a);

spacing apart the container (2) from the supporting plane (30) and making the container properly rest against surfaces of the jaws (12);

carrying out the operations provided for in the capping and/or control station on the container (2) properly resting against the jaw surfaces, while keeping the container spaced apart from the supporting plane (30);

wherein the neck (2*a*) is provided with a rigid collar (3), and wherein the step of bringing the jaws into the first operating position brings the jaws (12) into engagement with the region of the neck (2*a*) of the container (2) located immediately below the rigid collar (3) and such that the rigid collar (3) rests on an upper surface of each jaw (12), and wherein the jaws (12) are equipped with teeth (24) or rubber elements (26), the step of bringing the jaws into the first operating position brings the teeth (24) or the rubber elements (26) into engagement with either the region of the neck (2*a*) of the container located immediately below the rigid collar or the rigid collar, in order to retain the container (2) in the operating condition of the jaws (12).

7. The method according to claim 6, wherein:

the jaws (12) are equipped with horizontal teeth (24) or rubber elements (26) arranged to engage said region of the neck (2*a*) of the container (2) located immediately below the rigid collar (3) and, after the step of making the container properly rest against the surfaces of the jaws (12), the method includes the step of applying a grasping pressure to the neck (2*a*) so that the horizontal teeth (24) or rubber elements (26) grasp said region of the neck (2*a*) of the container (2) located immediately below the rigid collar (3) thereby blocking the container (2) during the operations carried out in the capping and/or control station.

* * * * *